United States Patent [19]

Marsden

[11] 4,335,988

[45] Jun. 22, 1982

[54] TRACKSIDE CAM CENTERING ARRANGEMENT

[75] Inventor: Dennis Marsden, Lake Stevens, Wash.

[73] Assignee: Pullman Incorporated, Chicago, Ill.

[21] Appl. No.: 163,239

[22] Filed: Jun. 26, 1980

[51] Int. Cl.[3] ..... B61D 7/030

[52] U.S. Cl. ..... 414/387

[58] Field of Search ..... 105/308 K, 241.1, 241.2; 414/373, 378, 383, 386, 387, 388, 401, 402, 572

[56] References Cited

U.S. PATENT DOCUMENTS

| | | | |
|---|---|---|---|
| 1,414,760 | 5/1922 | Szemanske | 414/387 |
| 2,086,283 | 7/1937 | Pierce | 410/124 |
| 2,529,588 | 2/1948 | Beckett | 410/124 |
| 3,151,751 | 10/1964 | Marini | 414/572 |
| 3,169,648 | 7/1962 | Tantlinger | 414/399 |
| 3,897,877 | 8/1975 | Vandermeer et al. | 414/36 |
| 4,120,412 | 10/1978 | Miller et al. | 414/387 |

*Primary Examiner*—Randolph A. Reese
*Assistant Examiner*—M. J. Hill
*Attorney, Agent, or Firm*—Richard J. Myers

[57] ABSTRACT

A trackside door closing arrangement for closing the swinging doors of a railway hopper car. This arrangement is self centering and shifts to counteract the cars lateral sway as it passes through the mechanism or shifts to accommodate cars that have parallelogramed during service.

11 Claims, 4 Drawing Figures

TRACKSIDE CAM CENTERING ARRANGEMENT

BACKGROUND OF THE INVENTION

1. Field of the Invention

The present invention relates to hopper cars of the type which discharges material through side discharge openings normally closed by means of outwardly swinging doors. More particularly the invention relates to a trackside closure mechanism positioned to close the swinging doors on both sides of the railway hopper car, irrespective of any parallelograming of the car, as it passes along the track into association with the closing mechanism.

2. Description of the Prior Art

Some of the patents exemplifying the prior art are U.S. Pat. Nos. 4,120,412; 3,897,877; 3,169,648; 3,151,751; 2,529,588; 2,086,283 and 1,414,760. In U.S. Pat. No. 4,120,412 the device operates in a relatively normal upright position and compensates for normal side sway or rolling movements of the car. However, beyond its limited capabilities it cannot reach out and fully close the door on the side of the car tilted away from the device beyond its operating parameters. In U.S. Pat. Nos. 3,897,877; 3,169,648; 3,151,751; 2,529,588 and 2,086,283 show various method of orientating, aligning and squeezing boxes, freight and the like and do not show or suggest the arrangement herein contemplated. U.S. Pat. No. 1,414,760 shows a device whereby the door of a mine car may be automatically opened but does not suggest compensating or conjoint movement.

SUMMARY OF THE INVENTION

The railway car utilized with the present invention comprises a plurality of hoppers having a central elongated hopper and two end hoppers which are particularly adapted for transporting elongated objects such as logs and the like, but the invention is not restricted thereto. The car includes lower side discharge openings and doors which are suitably locked by locking mechanisms, well know in the art. The type of doors used are hingedly supported on the side of the car and have portions extending laterally inwardly below the car for opening and closing hopper openings which are in communication with the interior of the car.

In the arrangements herein shown, three longitudinally elongated doors are provided on each side of the car. As the car arrives at its destination, the doors are opened and the load is dumped gravitationally, the doors remaining open until the car passes the dumping site. Beyond the site there are provided trackside door closing devices. The present invention entails three embodiments that are so designed to be self-centering in that as the car shifts laterally or has parallelogramed during service the door closing devices follow the lateral movements and/or irregular shape of the car so that the door closing devices at both sides of the car are properly related to the doors on their respective sides and will close said doors.

The invention comprehends interrelating the door closing devices in such a manner that the movements of the car and/or its irregular shape is translated into concurrent movements of the closing device.

These and other objects and advantages inherent in and encompassed by the invention will become more apparent from its description and the drawings.

DESCRIPTION OF THE PREFERRED EMBODIMENT

Figure 1:
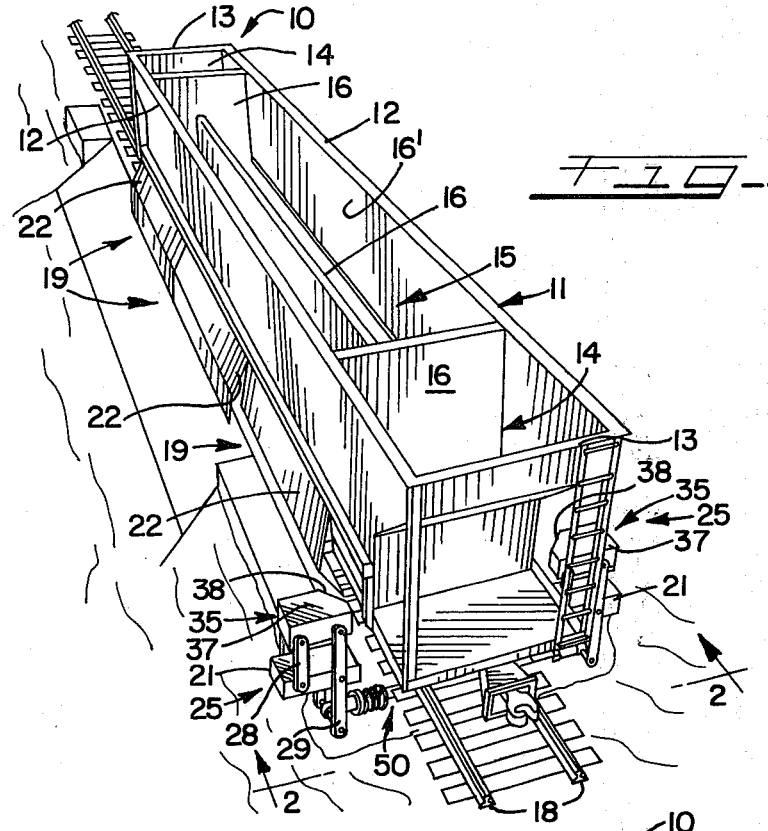
FIG. 1 is a perspective view of track section with a railway car incorporating one embodiment of the invention.

As shown in the drawings, a railway hopper car 10 comprises a car body 11 including side walls 12 and end walls 13. The railway hopper car body 11 comprises hoppers 14 separated by a central elongated hopper 15.

The lower portions of the hoppers comprise lower outwardly extending slope sheets 16 having vertical hopper sides 16'.

The hopper car is supported on conventional trucks 17 and tracks 18 and include outwardly swinging side doors 19. The side doors 19 comprise diagonal door sections 24 connected to vertical door sections 22 which in turn are pivotally supported on the sides of the car by means of hinge members 20. Each door closes a discharge opening generally designated 23. The specific door arrangement and door locking mechanism is shown and described in U.S. Pat. No. 4,158,996.

As illustrated in the drawings, supports, preferably in the form of concrete slabs 21, are positioned at opposite sides of the tracks 18. Each slab 21 is adapted to support a trackside door operating mechanism generally designated at 25.

Each mechanism 25 includes a pair of outer and inner upright parallel links 28 and 29 respectively which are pivotally connected at their upper ends on a horizontal axis by pins 30 and 32 to a cam member 35 which comprises a rectangular block 37 having a cam face 38 which is tapered away from the car 10 in the direction which the car is advancing and cam face 39 substantially parallel to the longitudinal orientation of the car 10. The cam surfaces engage the doors 19 and pivot them from unlocked position as shown in FIG. 1 to locked position as shown in FIG. 2.

In order for the cam member 35 to move rectilinearly toward and away with respect to the adjacent side of the railway car 10 the lower end of the outer link 28 is pivotally connected to slab 21 by pin 40. The inner link 29 is pivoted intermediate its ends to slab 21 by pin 42. The length of the outer link 28 between pins 30 and 40 is the same as the length of the section of inner link 29 between pins 32 and 42. Further, the links 28 and 29 are allowed to pivot on a horizontal axis.

The lower end portions 44 of inner links 29 are pivotally connected to clevises 46 and 48 on respective end portions adjacent end portions of an equalizer assembly 50. The equalizer assembly 50 is positioned below the tracks 18. Opposite ends of clevises 46 and 48 are pivotally connected to respective inner links 29 by pins 52 and 54.

Figure 2:
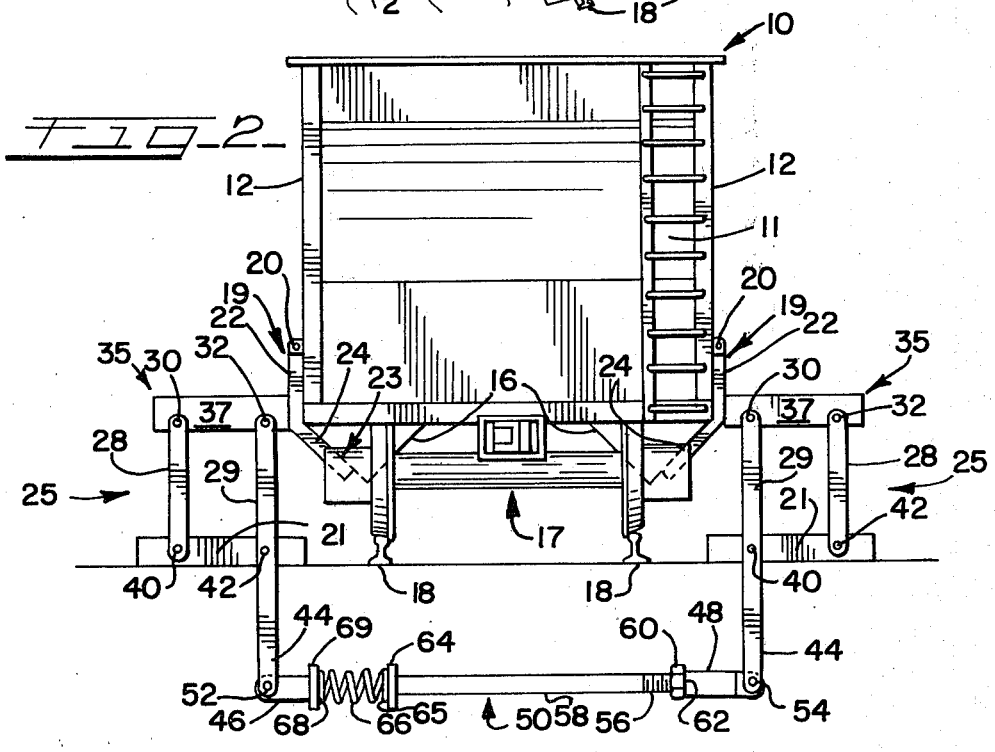
FIG. 2 is an enlarged end view taken substantially along line 2—2 of FIG. 1.
Figure 3:
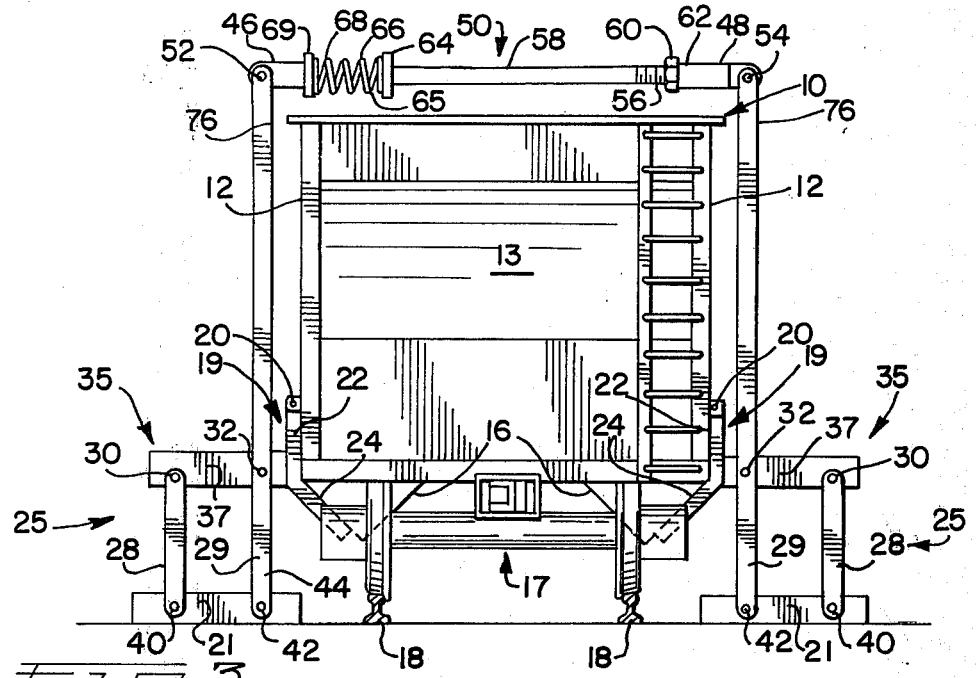
FIG. 3 is an end view illustrative of the second embodiment of the invention.
Figure 4:
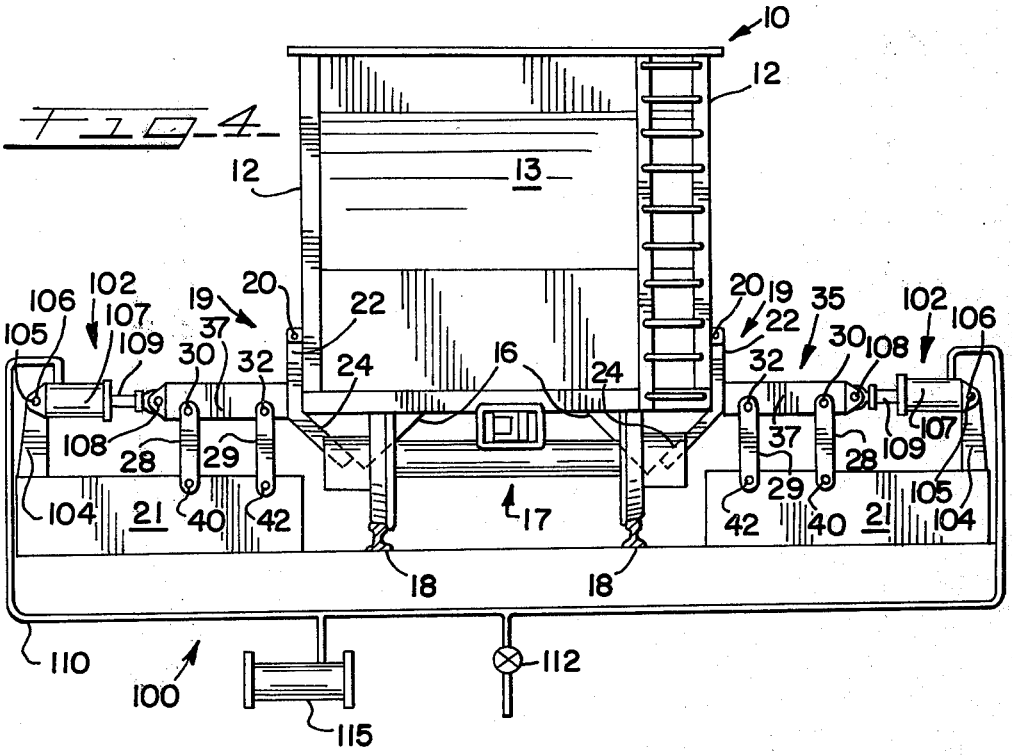
FIG. 4 is an end view similar to FIGS. 2 and 3 illustrating the third embodiment of the invention.

Clevis 48 is threaded to one end 56 of a push rod 58 and is held in adjusted position by a locking nut 60 which is threaded on the end 56 and tightened against surface 62 of clevis 48 as best seen in FIG. 2. The other end of rod 58 is provided with a spring seat 64 against which one end 65 of compression spring 66 is seated.

The spring 66 seats at its other end 68 against seat 69 provided on the inner end of clevis 46. Compression spring 66 is preloaded sufficiently to close the doors 19 and provide compliance in the mechanism to allow for irregularities in the distance between the doors when closed.

It will be realized that as the car 10 sways laterally or enters the area of the closure mechanisms askew and pushes toward one side, the respective closure mechanism toward which the car is advancing will move with the car in the same direction. The equalizer assembly 50 will cause the opposite closure mechanism to move and thus the proper relationship of closing mechanism to railway car 10 is maintained for closing the doors 19 on both sides irrespective of the extent of lateral sway or parallelograming of the railway car 10 as it passes between the closing mechanisms 25.

DESCRIPTION OF THE ALTERNATE EMBODIMENT

In this and other embodiments common parts will be identified with the same corresponding reference numerals.

The railway hopper car 10 has conventional wheel trucks 17 riding tracks 18 and hoppers 14 and 15 with doors 19 as hereinabove described. The doors 19 in the open position are engaged by cam members 25. The supports or slabs 21 at each side of the tracks 18 provide horizontal pivot pins 40 and 42. In this instance, the ends of outer link 28 are pivoted at pins 30 and 40 and inner link 29 is inverted and is pivoted at 42 to the slab 21, intermediately at pin 32 to cam member 35 and at its upper end 76 is pivoted at pin 52 to clevis 46. Further, the inner links 29 extend above the railway car 10 and are connected to opposite ends of the equalizer assembly 50 which spans the car 10. This embodiment operates exactly in the same manner as the previous embodiment.

DESCRIPTION OF THE ALTERNATE EMBODIMENT

In this embodiment a hydraulically or pneumatically operated door closing mechanism 100 is provided. Functionally it operates in exactly the same manner as the previous embodiments.

The support slabs 21 pivotally mount the lower ends of links 28 and 29 at pins 40 and 42. The upper ends of links 28 and 29 are pivoted to the cam member 35 at 30 and 32, respectively. A piston cylinder assembly 102 comprising a cylinder 107 and a piston 109 is mounted on a standard 104 at its upper end by pin 105 which extends through openings in ears 106 of the cylinder 107 and a corresponding opening (not shown) in the standard 104 so that the cylinder assembly 102 is pivotal on a horizontal axis generally parallel with the tracks 18. The piston 109 is pivoted to the outer end of a respective cam block 37 by pin 108. The cam block 37 has inner cam surfaces similar as to those shown and described by FIG. 1.

The cylinders are interconnected by flexible conduit or hydraulic lines 110 which are connected through a valve 112 to a source of fluid or air. An air accumulator or cushion tank 115 is provided in the conduit line 110 and preloaded sufficiently to close the doors 19 and provide compliance in the mechanism to allow for irregularities in the distance between the doors in their closed position. Thus the cam members 37 have always positioned simultaneously in operating door closing position to the respective side of the car.

The foregoing description and drawings merely explain and illustrate the invention and the invention is not limited thereto, except insofar as the appended claims are so limited, as those skilled in the art who have the disclosure before them will be able to make modifications and variations therein without departing from the scope of the invention.

What is claimed is:

1. For a railway hopper car suited for movement on rails having longitudinally extending doors on opposite sides thereof hingedly mounted on the car for movement laterally outwardly from closed position to open position relative to a discharge opening, the improvement comprising:

a pair of trackside door closing mechanisms disposed in position to flank said hopper car as it moves therebetween, means mounting said closing mechanisms comprising substantially parallel linkage and an equalizer assembly interconnecting said linkages, said equalizer assembly extending beneath said rails and said means mounting said closing mechanisms operatively interconnecting said closing mechanisms for conjunctive preset lateral movements in response to parallelograming and/or swaying of the railway car.

2. The invention in accordance with claim 1, and said means mounting comprising a camming means carried thereby.

3. The invention in accordance with claim 2, and said camming means comprising a cam element having a door engaging and closing cam face.

4. For a railway hopper car suited for movement on rails having longitudinally extending doors on opposite sides thereof hingedly mounted on the car for movement laterally outwardly from closed position to open position relative to a discharge opening, the improvement comprising:

a pair of trackside door closing mechanisms disposed in position to flank said hopper car as it moves therebetween, means mounting said closing mechanisms comprising substantially parallel linkage and an equalizer assembly interconnecting said linkages, said equalizer assembly disposed at an elevation above the railway car and said means mounting said closing mechanisms operatively interconnecting said closing mechanisms for conjunctive preset lateral movements in response to parallelograming and/or swaying of the railway car.

5. The invention in accordance with claim 4, and one of said substantially parallel links on each side of said rails extending upwardly from the trackside and connected to a respective adjacent end of said equalizer assembly.

6. The invention in accordance with claim 4, and said means mounting comprising a camming means thereby.

7. The invention in accordance with claim 6, and said camming means comprising a cam element having a door engaging and closing cam face.

8. For a railway hopper car suited for movement on rails having longitudinally extending doors on opposite sides thereof hingedly mounted on the car for movement laterally outwardly from closed position to open position relative to a discharge opening, the improvement comprising:

a pair of trackside door closing mechanisms disposed in position to flank said hopper car as it moves therebetween, means mounting said closing mechanisms comprising substantialy parallel linkage and an equalizer assembly interconnecting said linkages, said equalizer assembly being compressible to accomodate excessive lateral movements of said trackside door closing mechanisms and said means mounting said closing mechanisms operatively interconnecting said closing mechanisms for conjunctive preset lateral movements in response to parallelograming and/or swaying of the railway car.

9. For a railway hopper car suited for movement on rails having longitudinally extending doors on opposite sides thereof hingedly mounted on the car for movement laterally outwardly from closed position to open position relative to a discharge opening, the improvement comprising:

a pair of trackside door closing mechanisms disposed in position to flank said hopper car as it moves therebetween, each trackside door closing mechanisms having an actuating cylinder assembly, said mounting means including a common fluid connection between said assemblies and said means mounting said closing mechanisms operatively interconnecting said closing mechanisms for conjunctive preset lateral movements in response to parallelograming and/or swaying of the railway car.

10. For a railway hopper car suited for movement on rails having longitudinally extending doors hingedly mounted on opposite sides of the car for movement laterally outwardly from a closed to a open position relative to a discharge opening, a trackside door closing mechanism having a pair of components one on each side of the rails positioned to accommodate passage of said car with open doors therebetween and having means for closing the doors as the car moves through and, means responsive to movements of one component to correspondingly move the other component laterally of the car as the car sways back and forth in between the components during said movement therebetween to maintain said components in preset relation to each other and to said railway car so as to close the doors without fail on both sides of said car.

11. The invention in accordance with claim 10, and said means responsive to movements comprising an equalizer assembly and substantially parallel linkages interconnecting said components for conjoined movement.

* * * * *